United States Patent [19]

Sukup et al.

[11] Patent Number: 4,708,202

[45] Date of Patent: Nov. 24, 1987

[54] DRILLABLE WELL-FLUID FLOW CONTROL TOOL

[75] Inventors: Richard A. Sukup, Burleson; Monty E. Harris, Azle, both of Tex.

[73] Assignee: The Western Company of North America, Fort Worth, Tex.

[21] Appl. No.: 884,877

[22] Filed: Jul. 8, 1986

Related U.S. Application Data

[63] Continuation of Ser. No. 611,341, May 17, 1984, abandoned.

[51] Int. Cl.[4] ..... E21B 23/00

[52] U.S. Cl. ..... 166/123; 166/127; 166/133; 166/376

[58] Field of Search ..... 166/118, 123, 127, 128, 166/133, 140, 182, 376

[56] References Cited

U.S. PATENT DOCUMENTS

| | | | |
|---|---|---|---|
| 2,205,119 | 6/1940 | Hall et al. | 166/376 |
| 3,433,301 | 3/1969 | McEver, Jr. | 166/128 |
| 3,695,352 | 10/1972 | McGill | 166/127 |
| 3,861,465 | 1/1975 | Mignotte | 166/127 |
| 4,151,875 | 5/1979 | Sullaway | 166/133 |
| 4,153,109 | 5/1979 | Szescila | 166/123 |
| 4,296,806 | 10/1981 | Taylor et al. | 166/140 |
| 4,441,552 | 4/1984 | Hamman | 166/133 |

*Primary Examiner*—Stephen J. Novosad
*Assistant Examiner*—William P. Neuder
*Attorney, Agent, or Firm*—Richards, Harris, Medlock & Andrews

[57] ABSTRACT

A downhole tool for controlling the flow of fluids through the well casing includes a tubular mandrel with a flow control valve therein. A radially expandable seal member encircles the mandrel and a sub-bottom defines an abutment member, attached to and movable with the mandrel, for engaging one side of the seal member. A bottom cone is positioned around the mandrel and on the opposite of the seal member from the sub-bottom. The cone has a sleeve extending therefrom positioned between the seal and the mandrel on which the seal member is carried. An upper cone is positioned around the mandrel with slips segments being positioned between the upper and bottom cones. An upper radially expandable seal member encircles the mandrel and its carried on a sleeve extending from the upper cone. A lock hub is positioned around the mandrel and on the side of the upper cone opposite the upper seal and slip segments. The hub is slideable on the mandrel toward the sub-bottom for forcing the cones to converge against the slip segments, causing the segments to ride up on the cones and move radially outwardly. Sequentially the expandable seals are compressed and expanded radially outwardly for engagement against the casing wall. To facilitate drillability, components of the tool are formed of a synthetic resin composite, specifically a polyamide material that is glass fiber filled at a level of a minimum of about 30% by weight, having an extremely high modulus of elasticity and having a heat deflection temperature of about 400° F. fully loaded.

32 Claims, 14 Drawing Figures

DRILLABLE WELL-FLUID FLOW CONTROL TOOL

This application is a continuation of application Ser. No. 611,341, filed May 17, 1984 now abandoned.

TECHNICAL FIELD

The present invention relates to permanent downhole tools used in oil and gas wells and more particularly to tools requiring relatively low setting forces and which are readily drillable for removal.

BACKGROUND ART

Special fluid control tools are used downhole in oil and gas wells during cementing of the well casing as well during well stimulation procedures used to improve well production. These tools include squeeze packers which are used both in completion and increasing production from the well. The cement retainer and bridge plug are examples of squeeze packers commonly used to conduct various downhole completion and service operations.

These production and service tools may be either of the retrievable or permanent type. Retrievable tools are those which may be set and released by manipulating the tool using either the drill string, a wireline or hydraulic control. Because of the additional complexity and expense involved in using retrievable tools, permanent tools are often used in the operation. These tools normally are set in place and are removable only by drilling the tool out of the casing, through conventional rockbit or milling tool methods.

Permanent tools must be substantially built to withstand the pressures and temperatures encountered at the subterranean level at which they are used. Typically, the tools must be made of drillable materials capable of withstanding 30,000 to 40,000 tensile stress and temperatures up to 300° F. In relatively deep wells, that is those deeper than 10,000 feet, even higher pressures and temperatures are encountered.

Squeeze packer production and service tools normally include holding devices, commonly referred to as "slips". These holding devices are used to engage the wall of the casing to restrain tool movement under well bore dynamics Further, the tools incorporate "pack-off" seals for sealing the casing annulus. These seals permit separating areas where differential pressures are applied and for isolating areas within the casing from other areas at varying depth.

Although tools are referred to as "permanent", it may be necessary to remove such tools. This is accomplished by drilling through the tool, and circulating the remains of the tool to the surface for removal. To facilitate drillability of tools, cast iron, rather than steel, is used. Some attempts have been made in the past to use magnesium and other exotic metals which have sufficient strength of material properties. Even using these materials, such tools have required considerable effort to remove through drilling. And because drilling time is rig time, such removal is costly. For example, to remove a permanent cement retainer of the type normally used today, 4 to 6 hours may be required, under ideal conditions.

Further, present design squeeze packers require relatively high internal setting forces and, in many applications, require top and bottom slips with associated cone assemblies for expanding these slips for engagement with the casing wall. As a result of their design, these top and bottom slips are inherently dragged or pulled up the side of the well casing during setting procedures resulting in the "dulling" of the slip teeth. Additionally, present designs often permit the upward movement of the packing element and back up rings during setting, causing a "chafing" of the rubber surfaces. It is not uncommon for a given size squeeze packer or bridge plug to travel four to six inches up the well during setting. Because the tool is not restrained from movement in the casing, the force which can be applied "at the tool" is significantly decreased. Further, the prior art designs which incorporate both top and bottom slips, can result in setting of the tool in a skewed or cocked position in the casing. For example, because the top slip is set first, the tool position upon setting may be skewed relative to the axis of the casing. If this situation occurs, proper setting of the bottom slip may be difficult or impossible. While these designs have been generally acceptable, they have not provided the most efficient arrangement for squeeze packers and related drilling and production tools.

Thus, a need exists for a readily drillable squeeze packer requiring a relatively low internal setting force with an improved holding slip and structure for seating such structure and in expanding the seal pack-off assembly.

DISCLOSURE OF THE INVENTION

The present invention relates to downhole tools for controlling the flow of fluids through the well casing in an oil or gas well. In one embodiment of the invention, the tool is a cement retainer used to pack-off the well casing and permit the injection of cement through a valve in the tool for deposit in the annulus between the casing and the well bore. The tool includes a tubular mandrel having a flow passage therethrough with structure for connecting one end of the mandrel to the well drill string. The second end of the mandrel has a flow control valve therein. A radially expandable seal member encircles the mandrel, and a sub-bottom defines an abutment member, which is attached to and movable with the mandrel, for engaging one side of the seal member. A bottom cone is positioned around the mandrel and on the opposite side of the seal member from the sub-bottom. The cone has a sleeve extending therefrom which is positioned between the seal and the mandrel. Thus, the seal member is carried on the sleeve rather than engaging the mandrel directly. The cone also is designed with a conical surface on a face opposite the seal member.

An upper cone is positioned around the mandrel and has a conical face confronting the conical surface of the bottom cone. Slip segments are positioned around the mandrel and between the cones. The slip segments are designed as a single center slip unit having opposed conical surfaces for cooperating with confronting conical surfaces of the cone members positioned to either side of the slip segments. An upper radially expandable seal member encircles the mandrel and is carried on a sleeve extending from the upper cone. A lock hub is positioned around the mandrel and on the side of the upper cone opposite the upper seal and slip segments. The hub is slidable on the mandrel and may be selectively advanced relative to the mandrel toward the sub-bottom to force the cones to converge against the slip segments. This movement causes the segments to ride up on the conical surfaces of the cones and move radially outwardly against the casing wall. Sequentially, the expandable seals are compressed and expanded radially outwardly for engagement against the casing wall.

In accordance with a further embodiment of the invention, an annular back-up ring, having a wedge shaped cross section, is positioned between each of the cones and its corresponding seal member. An annular pocket is formed within the cone radially inwardly of the conical surface to remove unnnecessary material to improve drillability. An O-ring seal is positioned in an annular groove formed in the face of the sleeve confronting the mandrel for providing a seal between the sleeve and the mandrel.

In another embodiment of the invention, a single seal member is positioned around the mandrel between an upper cone and lock hub. In this embodiment, a lock hub surrounds the mandrel and is movable toward the abutment member to engage the slip segments on confronting conical members to cause their radially outwardly movememt. Similarly, the seal member is compressed to expand radially outwardly for engagement with the well casing. In this embodiment, the radially expandable seal member rides on a sleeve extending from the upper cone rather than engaging the mandrel.

In another embodiment of the invention, the flow control valve positioned in the mandrel is of the movable sleeve type having a plurality of apertures for registration with apertures in the mandrel sidewall when the valve is in the "open" position. The angle of orientation of the apertures through the sidewall of the mandrel corresponds to that of the apertures through the valve to facilitate flow therethrough. Further, the area defined by the apertures making up the flow channel through the valve is equal to or greater than the cross-sectional area through the setting tool through which fluid flows through the mandrel for discharge through the valve.

In still another embodiment, the tool is used as a bridge plug and therefore does not incorporate a flow control valve.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION

Figure 1:
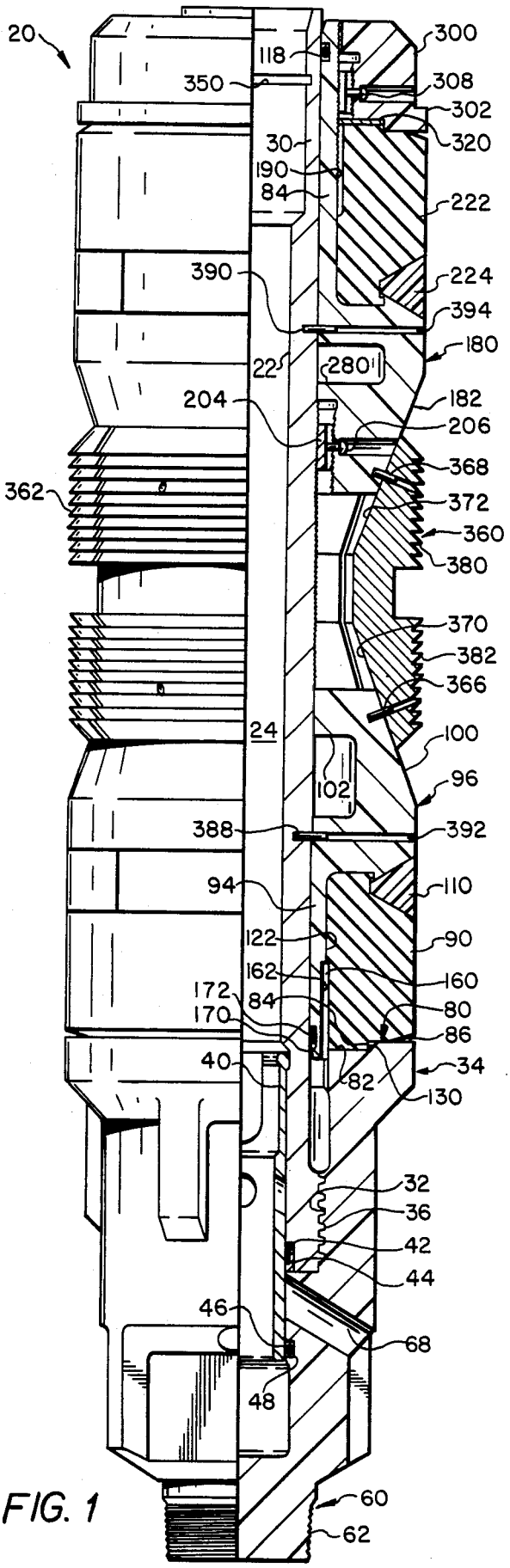
FIG. 1 shows the tool of the present invention in quarter-section and in the unset or running-in position.

FIG. 1 is a quarter section view of a downhole tool 20 incorporating the present invention. The tool shown in FIG. 1 is a cement retainer, although it will be appreciated that the inventive aspects of the present invention may also incorporated into similar downhole tools used for fluid flow control in the well casing.

Tool 20 includes a tubular mandrel 22 having a central flow passage 24 therethrough. The upper end of mandrel 22 is provided with means, such as box end 30, for joining the tool to a pipe string T (FIG. 7) which extends to the surface of the well. The lower end of the mandrel has threads 32 for receiving a bottom assembly 34. A valve assembly 40 is captured between bottom assembly 34 and the lower end of mandrel 22. An annular sleeve seal 42 is seated between valve assembly 40 and an annular receiving groove 44 in the lower end of mandrel 22 to form a seal between valve assembly 40 and the mandrel. An O-ring seal 46 is seated within gland 48 of bottom assembly 34 to provide a seal between bottom assembly 34 and valve assembly 40. The lower end of bottom assembly 34 has a pin end 60 having threads 62 thereon for receiving other accessories or tools thereon. Bottom assembly 34 has one or more ports 68 therethrough. By selective movement of valve assembly 40, port 68 may be made to register with central flow passage 24 within mandrel 22.

Bottom assembly 34 includes an abutment face 80 transverse to passage 24 with a radially inward portion 82 separated by step 84 from a radially outward portion 86. An elastomeric seal 90 encircles mandrel 22 and is positioned against abutment face 80 as shown in FIG. 1. Elastomeric seal 90, generally referred as a packing element, is separated from mandrel 22 and rides on a sleeve 94 extending from a bottom cone 96 which also encircles mandrel 22. Cone 96 includes a conical outwardly facing surface 100 and has an annular void 102 to eliminate unneeded material to aid in drillability and reduce the engagement surface of the cone with mandrel 22.

Figure 5:
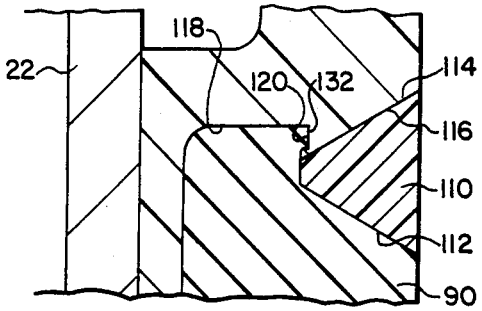
FIG. 5 is an enlarged section of the lower seal, backup ring and lower cone area of the tool.
Figure 6:
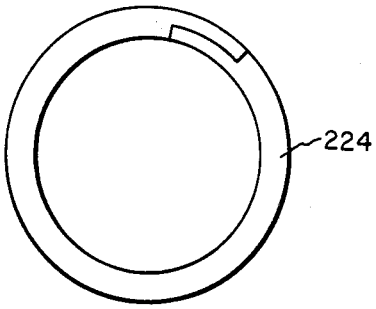
FIG. 6 is a plan view of one of the backup rings of the tool.

Referring to FIGS. 1 and 5, ring backup 110 is positioned between cone 96 and elastomeric seal 90. Ring backup 110 has a wedge cross-section with inwardly tapering side walls 112 and 114 which correspond to complimentary walls on seal 90 and cone 96, respectively. Cone 96 has a conical wall 116 which corresponds to side 114 of ring back up 110. Wall 116 is connected to vertical wall 118 by step 120.

The outside surface of sleeve 94 is defined by a wall 122 which has a key way 162. Seal 90 is formed with steps 130 and 132 for mating with steps 84 and 120, respectively, of bottom assembly 34 and cone 96, respectively, to assist in retaining the seal in position. A square key 160 is seated in key way 162 of sleeve 94 of cone 96 and rides in a key way 164 within bottom assembly 34.

A gland 170 is formed in the inside face of sleeve 94 and receives an O-ring 172. As can be seen in FIG. 1, O-ring 172 forms a seal against mandrel 22.

A top cone 180 encircles mandrel 22 and has a conical downwardly facing surface 182. Top cone 180 also includes a sleeve 184 extending therefrom and having an annular groove 186 near the end for receiving an O-ring 188 for sealing between sleeve 184 and mandrel 22. The outer surface of sleeve 184, over a length adjacent the end thereof, has rachet teeth 190 formed therein for cooperating with a lock ring 204.

Figure 4:
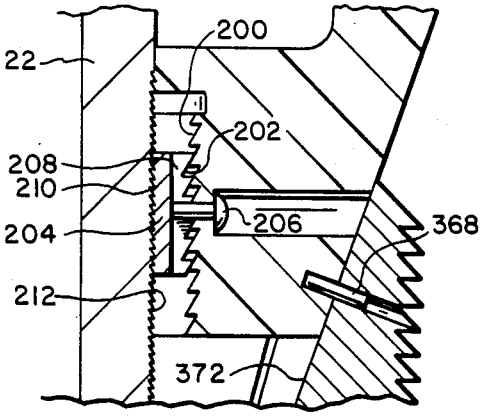
FIG. 4 is an enlarged section of the upper cone and its engagement with the mandrel.

Referring to FIG. 4, in conjunction with FIG. 1, the lower end of cone 180 has wickers or teeth 200 for cooperating with teeth 202 of lock ring 204. Rotation of lock ring 204 relative to cone 180 is prevented by use of an appropriate pin 206 which engages slot 208 in lock ring 204. The inside diameter of lock ring 204 is also formed with teeth 210 for cooperating with teeth 212 formed on the outside wall of mandrel 22.

Figure 3:
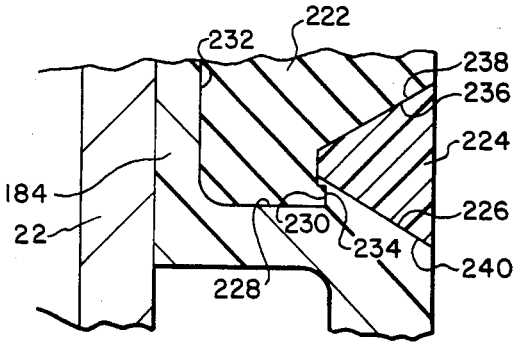
FIG. 3 is an enlargd section of the upper seal, backup ring and upper cone area of the tool.

As with lower cone 96, upper cone 180 has material removed to form annular space 280. The top cone is further designed to receive upper seal 222 with a back up ring 224 positioned between seal 222 and top cone 180. Top cone 180 includes a tapered wall 226 separated from a horizontal wall 228 by step 230. (FIG. 3) The outside wall of sleeve 184 is defined by a wall 232. Seal 222 has a step 234 for positioning against step 230 and a tapered wall 236 for cooperating with tapered wall 238 of back up ring 224. Back up ring 224 further has a tapered wall 240 for cooperating with tapered wall 226 of cone 180.

Figure 2:
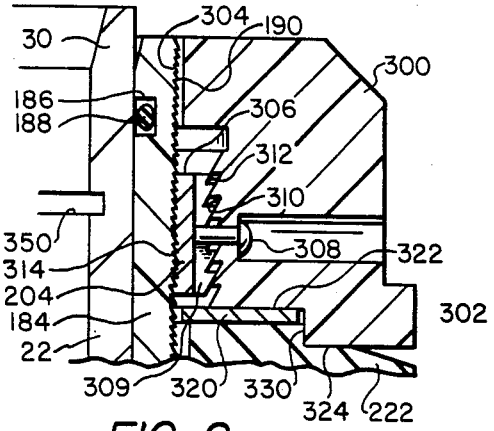
FIG. 2 is an enlarged section view of the lock hub and its engagement with the mandrel.

Referring to FIGS. 1 and 2, a lock hub 300 is positioned around mandrel 22 and above seal 222. Hub 300 has collar 302 formed therefrom and a central bore 304 of slightly greater than the outside diameter of sleeve 184. Hub 300 is formed with a concentric bore for receiving lock ring 306 therein which is restrained from rotation by pin 308 which engages slot 309 in ring 306. Lock ring 306 has teeth 310 for cooperating with teeth 312 of hub 300. Lock ring 306 also has teeth 314 on the interior surface for cooperating with teeth 190 of sleeve 184. A ring 320 is received within concentric bore 322 of hub 300. Bore 322 defines a step to a transverse wall 324. Seal 222 is formed with a step 330 for engaging the step formed by bore 322. As can be seen from FIG. 1, seals 90 and 222 may be identical in configuration and not necessarily of the same materials or hardnesses.

Referring to FIG. 1, a slip assembly 360 is positioned intermediate of bottom cone 96 and top cone 180 and has a plurality of slip segments 362 spaced around mandrel 22. Slip segments 362 are also attached to cones 96 and 180 by a plurality of shear pins 366 and 368, respectively, which hold the slips in place. Segments 362 have opposed conical faces 370 and 372 of an angle corresponding to that of conical surfaces 100 and 182 of cones 96 and 180, respectively. Slip segments 362 have teeth 380 and 382 formed therearound. Cones 96 and 180 are attached to mandrel 22 by a plurality of shear pins 388 and 390, respectively. Shear pins 388 and 390 are inserted through apertures 392 and 394 formed in cones 396 and 180, respectively. These pins prevent the premture movement of cones 96 and 180, and thus the premature setting of the slips. In one embodiment of the invention, pins 390 are smaller than pins 388 and require a lower shear force for severing. Thus, in operation of the tool, upper cone 180 may be moved in advance of the movement of lower cone 96.

Figure 7:
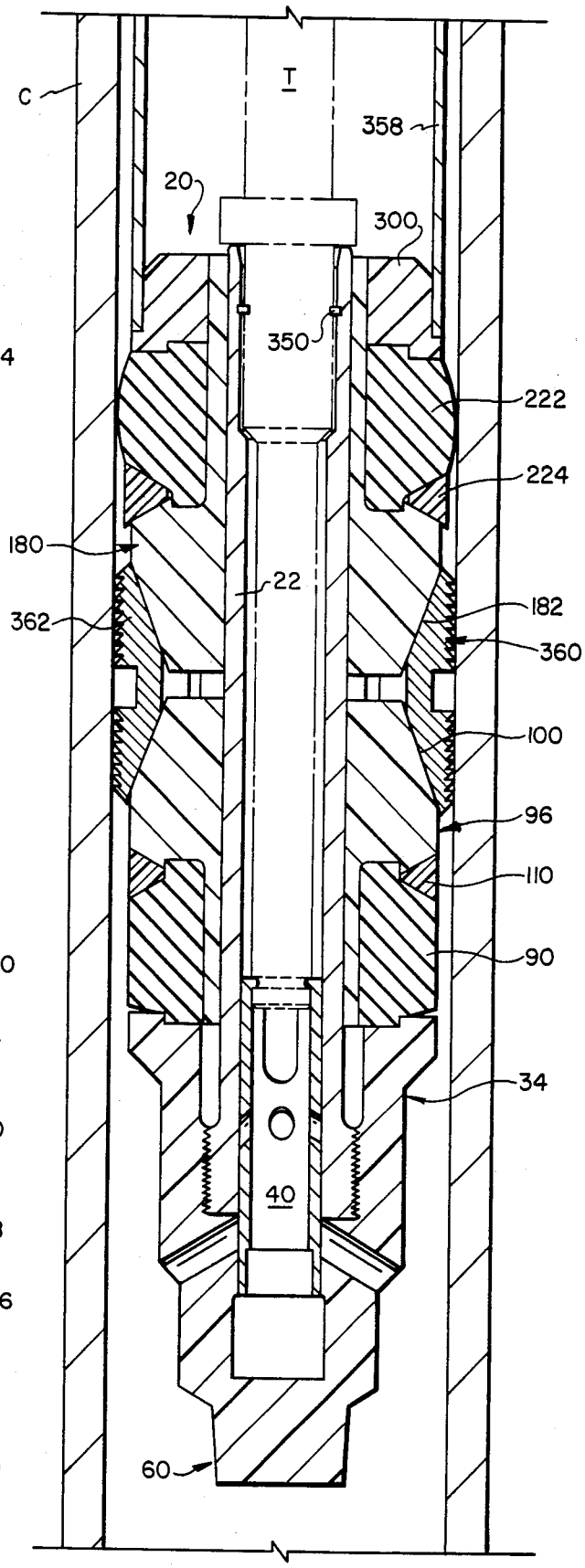
FIG. 7 is a sectional elevation view of casing within a well bore showing the tool with the slip segments set.

Operation of the tool is as follows. Referring to FIG. 7, tool 20, mounted on the end of a wire line or drill string using a setting tool T, is run in the well casing C with slip 360, cones 96 and 180 and seals 90 and 222 and lock hub 300 in the position shown in FIG. 1. Setting tool T is attached to tool 20 at shear ring 350 which engages the inside wall of mandrel 22. The setting tool also includes a sleeve 358 which may be moved relative to the structure of the tool engaging shear ring 350 such that it abuts collar 302 of lock hub 300.

With tool 20 positioned within the well casing of the desired depth, the tool is set by advancing sleeve 358 of the setting tool relative to the portion of the tool engaging mandrel 22 by way of shear ring 350. This in turn causes movement of lock hub 300 along mandrel 22 toward bottom assembly 34. As can be seen from the position which is reached in FIG. 7, cones 96 and 180 are moved inwardly relative to slip 360, shearing pins 366 and 368 (FIGS. 1 and 4), and moving the slip segments 362 radially outwardly against casing C. Teeth 210 of lock ring 204 move relative to teeth 212 of mandrel 22, thereby setting top cone 180 relative to mandrel 22. Lock ring 204 prevents the release of this engagement.

The shear pin in the top cone will shear at a predetermined value releasing the cone from the mandrel, and the lower pin shears at a higher value. These shear pins prevent a release of the cones from the mandrel during run-in to avoid a premature set. This sets the tool relative to the casing.

Figure 8:
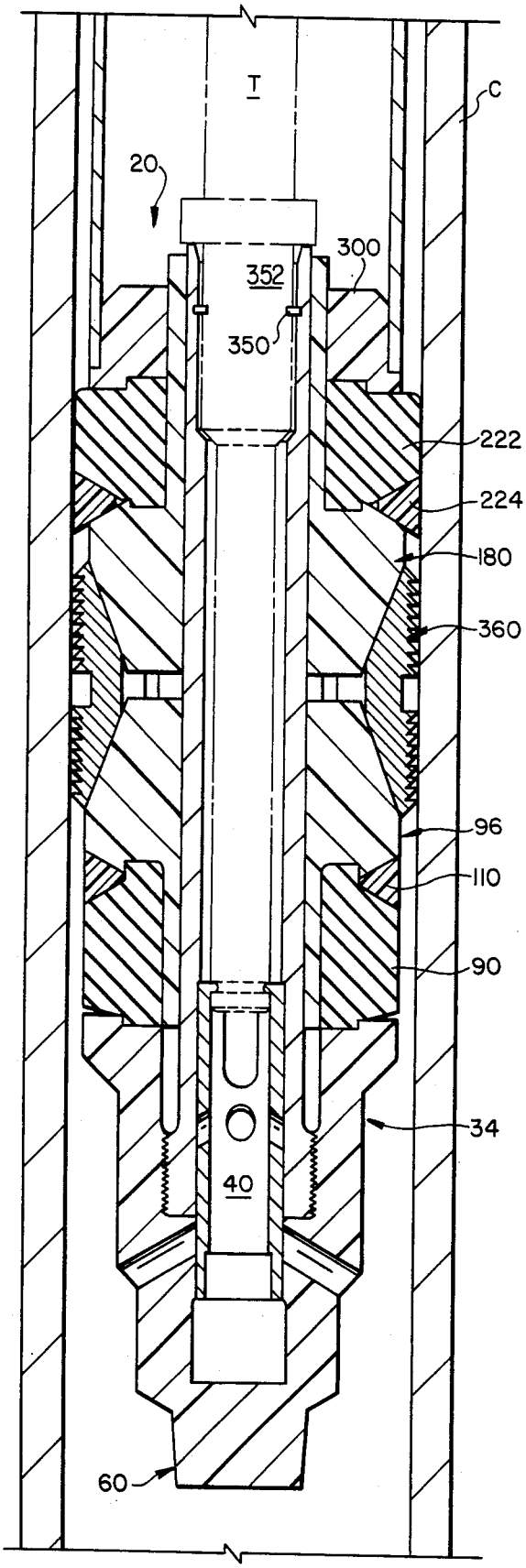
FIG. 8 is a sectional elevation similar to FIG. 7 but showing the tool with the top packing seal set.
Figure 9:
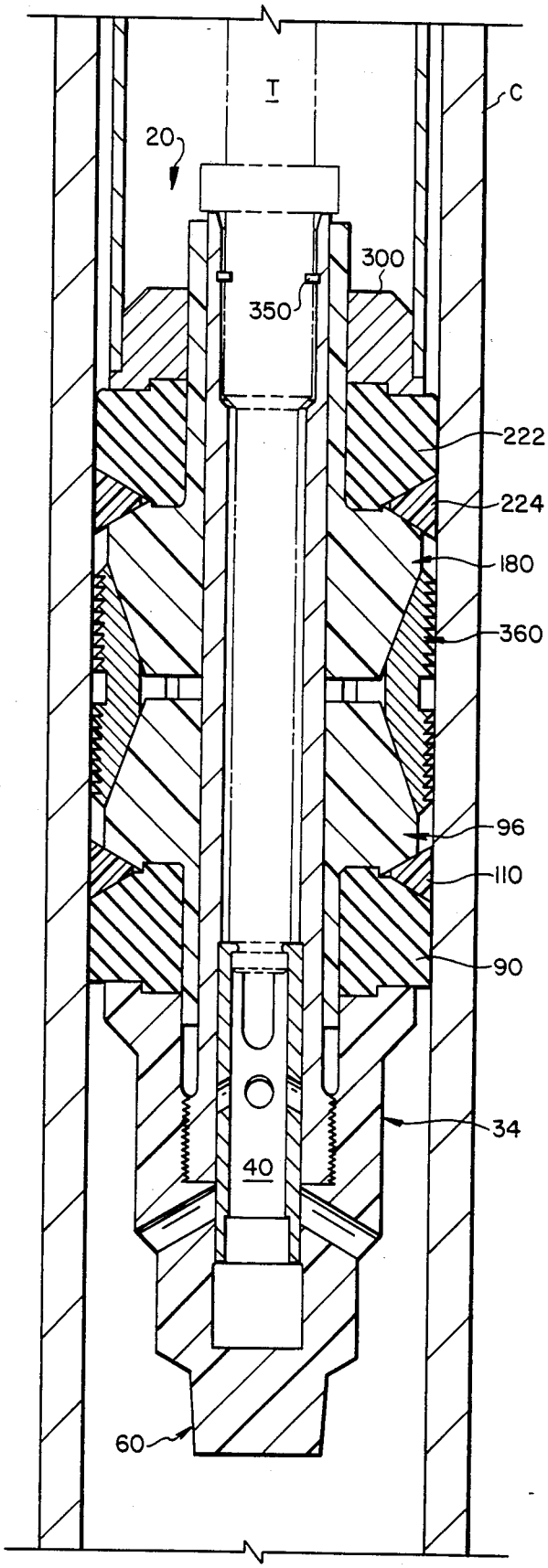
FIG. 9 is a sectional elevation similar to FIG. 8 but showing the tool with both the top and bottom packing seals set.

Sequentially, seals 222 and then 90 are compressed longitudinally and as result are expanded radially to engage the wall of casing C to seal off the annulus between the tool and the casing. More specifically, as lock hub 300 moves relative to mandrel 22, the rachet teeth 314 of lock ring 306 move along corresponding teeth 190 of sleeve 184 of cone 180. This results in the longitudinal compression of seal 222 as shown in FIG. 8. In view of the design of these teeth, this compression is not releaseable. At a predesigned setting pressure, sleeve 352 of tool T shears a connection within a portion of the setting tool engaging shear ring 350. In a second sequence step, an upward pull or strain is applied to mandrel 22 to lift bottom assembly 34. Due to the engagement of slip segment 362 against the casing wall, movement of bottom assembly 34 upwardly results in the compression of bottom seal 90 to pack off the seal against the casing as shown in FIG. 9. It can be appreciated that the expansion of backup rings 224 and 110 is corresponding to the expansion of packing element seals 222 and 90. Backup ring 224 acts as a bridge or barrier to limit extrusion of seal 222 from pressure from above. Likewise, backup ring 110 acts as a bridge or barrier to limit extrusion of seal 90 from pressure from below, as shown in FIG. 9. During the upward movement of mandrel 22, teeth 210 of lock ring 204 advance relative to teeth 212 of the mandrel thereby setting the radial expansion of lower seal 90.

As can be appreciated from review of FIGS. 1 and 2, seals 90 and 222 do not ride on mandrel 22 during setting. Instead, sleeves 94 and 184 are positioned between seals 90 and 222, respectively, thereby reducing the relative movement between the seals and their underlying surface. Instead, O-ring seals 172 and 188, positioned between sleeves 94 and 184, respectively, form the seals between the bottom and top cones and mandrel 22. Thus, the load required to set the tool is greatly reduced. Further, the setting of the seals in the present invention are performed sequentially. Thus, the upper seal may be set to withstand a lesser hydraulic pressure than the lower seal, as is often required. Further, the setting of the lower seal, to withstand higher "from below" pressures, can be accomplished with less setting force because of the isolation of the upper seal from direct engagement with the mandrel.

The present design also provides for a single opposed, centered slip design cooperating with confronting cone members for acutating the slips.

With the tool set, cement or other fluids may be directed through the central flow passage 24 and valve 40 for discharge through outlet 68 below the seals 90 and 222.

The tool of the present invention is a "permanent" cement retainer in that once the tool is set in place, release is not possible by mechanical release features. To remove the tool, either for purposes of exploring other zones of interest or to permit the entry of other service or work over tools, the tool is drilled out.

The improved drillability of the present tool is a result of a number of features incorporated in the tool. The present design provides for the forming of a number of the components of the tool from high strength synthetic resins. The most preferred material for these components is a nylon (polyamide) material that is glass fiber filled at a level of a minimum of about 30% by weight, having an extremely high modulus of elasticity and having a heat deflection temperature of about 400° F. fully loaded. Other suitable molded resins may be substituted for the preferred filled nylon, provided they meet the requirements contained herein.

Other suitable materials used to prepare components of the tool should have a modulus of elasticity between about 900,000 to 4,000,000 pounds per square inch, preferrably about 1,000,000 to 3,000,000 pounds per square inch. The material should also have a heat deflection temperature between about 300° F. and 600° F., preferably between about 400° F. to about 525° F., fully loaded. Generally, these will be injected or compression molded thermoplastic or thermoset synthetic resins.

The preferred material exhibits a maximum tensile strength of approximately 30,000 psi and is capable of withstanding temperature of at least 300° F. before experiencing excess growth or elongation. In the present invention, several components may be molded from the above described thermoformed material including bottom assembly 34, ring back up 110, cones 96 and 180, ring backup 224 and lock hub 300. With these components formed from the described materials, drilling time required for removal of the tool of the present invention is greatly reduced. It is expected that in certain applications, drilling times may be reduced by a factor of four.

Thus, the present invention provides a downhole tool and particularly a cement retainer, which requires a relatively low force for setting the tool. The low setting force required is a result of the unique design and positioning of the seals of packer elements relative to the adjacent cone members and positioning of the seal for movement with and separation from the mandrel by a sleeve extending from the bottom and top cone structures. Further, sealing between the cone and the mandrel is by way of a single O-ring for each cone. A single slip assembly is positioned intermediate of the movable bottom and top cone, and expandable pack-off seals are positioned to each side of the cones opposite the slip assembly. Backup rings are incorporated for use in conjunction with the pack-off seals.

Further, the present invention provides a permanent downhole tool that is readily removable by drilling in view of use of synthetic resins as the material of construction for various components in the tool. In one embodiment of the invention, the bottom assembly, bottom and top cones, backup rings and lock hub are made from high strength synthetic resins having relatively high tensile strength, on the order of 30,000 psi maximum, but which is readily drillable compared to cast iron normally used to form these components. With respect to other materials which have been used in the past, such as magnesium or aluminium, the presently described materials provide a tool which is inherently stronger than aluminum or magnesium due to higher mechanical properties and is more easily removed by drilling, requiring less time and less likelihood of damage to drill bits or surface components used in drilling out the tool.

Figure 10:
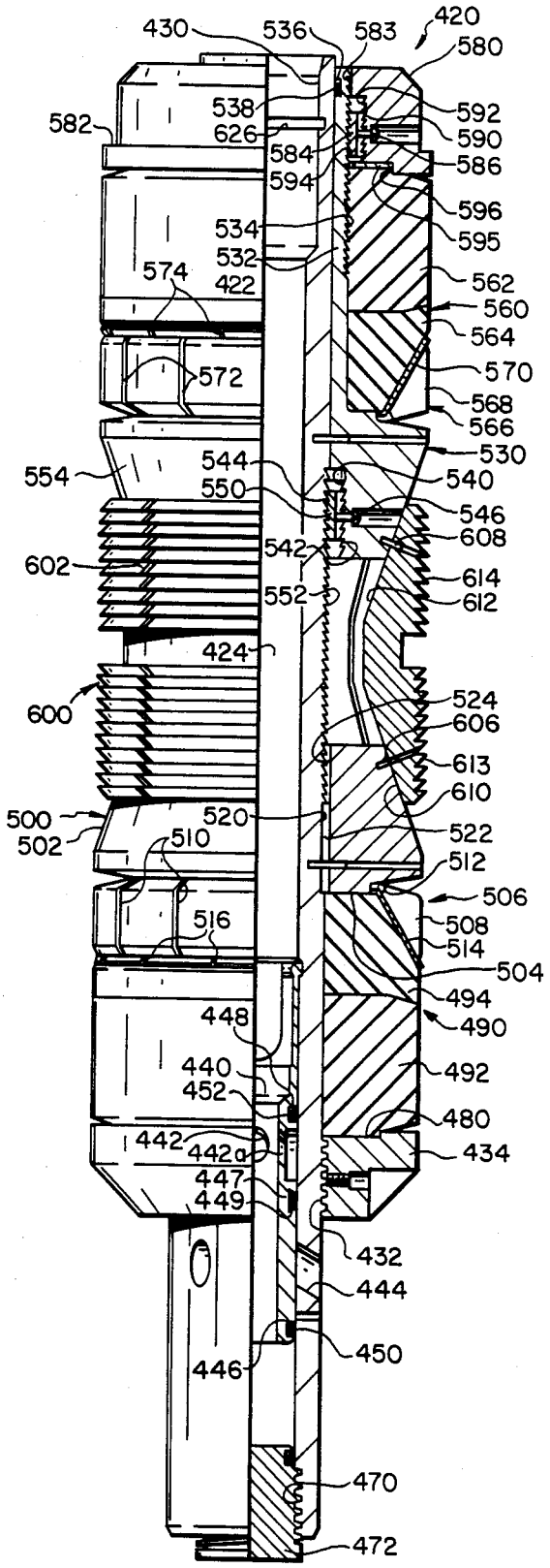
FIG. 10 shows an alternative embodiment of the tool of the present invention in quarter-section and in the unset or running-in position; the tool of FIG. 10 is for use in high pressure, high temperature environments.

The tool 420 shown in FIG. 10 has some similarity to tool 20 shown in FIGS. 1–9 but is designed for a high-pressure, high-temperature operation. The tool may be used in situations where approximate working pressures of 12,000 psi and temperatures of 350° F. are experienced. The tool in this configuration, when used for high pressure, high temperature conditions, will not incorporate the use synthetic resin components as in the tool disclosed in FIGS. 1–9. However, it will be appreciated that in use of tool 420 for lower pressure conditions and where temperatures will not exceed 300° F., components of the tool may be advantageously made from the synthetic material discussed above.

Tool 420 includes a tubular mandrel 422 having a central flow passageway 424 therethrough. The upper end of mandrel 422 is provided with an opening 430 for receiving a setting tool or a appropriate connector for attachment of the tool to the pipe string or wire line which extends to the surface of the well. The lower end of the mandrel has threads 432 for receiving a bottom assembly 434. A valve assembly 440 is positioned inside the mandrel and has a plurality of ports 442 for registering with ports 444 through mandrel 422 to permit the flow of fluid from the central passageway to the exterior of the tool. The location of this valve assembly 400 inside the mandrel eliminates the need for a housing similar in design to bottom assembly 34 of the embodiment in FIG. 1. Such elimination of a housing made of cast iron for higher order working pressures, reduces overall tool composition and inherently improves drill-out or removal time. Glands 446 and 448 are formed in the valve and receive O-rings 450 and 452, respectively, to provide a seal between the valve and the mandrel. Valve 440 also includes an annular groove 447 for receiving a seal 449 for forming a seal between the valve and the mandrel. A setting tool T is receivable within mandrel 422 for moving the valve between an open and closed position as is well known in the art. Ports 444 have side walls **444*a* oriented at an acute angle to the longitudinal axis of the tool. Further, ports 442 through valve 440 have side walls 442*a* oriented at an acute angle to the longitudinal axis of the tool and corresponding to that of walls 444*a* of ports 444. Thus, when valve 440 is positioned in the "open" position such that ports 442 register with ports 444, the side walls of these ports are aligned to facilitate flow of fluid therethrough. It may also be appreciated that the design of the valve is such that pressure on the bottom side of seal 450** and 449 sees the same pressure as above seal 452, thereby providing equalized pressure over the valve and facilitating its operation.

The lower end of mandrel 422 has internal threads 470 for receiving a plug 472, or other attachment as may be selected by the operator.

Bottom assembly 434 has an abutment face 480. An elastomeric seal 490 encircles mandrel 422 and is positioned against abutment face 480. Seal 490 includes components 492 and 494 having different durometer values as required for the particular application. A bottom cone 500, having a conical face 502 facing away from seal 490, encircles mandrel 422 and has a face 504 for engagement with seal component 494. A two part backup ring assembly 506 is positioned between seal 490 and bottom cone 500. Backup ring assembly 506 includes a carbon steel or ductile iron ring 508 having serrations 510 partially therethrough and connected at the lower end 512. Backup ring assembly 506 also includes a more flexible inner ring 514, also having serrations 516 but connected along the inner diameter. In assembly, serrations 516 are staggered in position relative to serrations 510 of ring 508, as shown in FIG. 10.

Mandrel 422 has a keyway 520 for receiving a key 522 for engaging keyway 524 of cone 500. This engagement prohibits rotation of cone 500 relative to mandrel 422.

A top cone 530 also encircles mandrel 422 and has a sleeve 532 extending therefrom. Sleeve 532 has ratchet teeth 534 formed on the outside surface from the end to a point intermediate of the length of the sleeve. Ring 532 has a gland 536 formed therein and houses an O-ring 538 for sealing engagement between sleeve 532 and mandrel 422.

The lower end of cone 530 has wickers or teeth 540 for cooperating with teeth 542 of lock ring 544. Rotation of lock ring 544 relative to cone 530 is prevented by the use of an appropriate pin 546 which engages a slot in lock ring 544. The inside diameter of lock ring 544 is also formed with teeth 550 for cooperating with teeth 552 formed on the outside wall of mandrel 422.

As with lower cone 500 upper cone 530 has a conical face 554 which confronts the conical face 502 of lower cone 500. As in the earlier embodiments, shear pins are used to maintain lower and upper cones 500 and 530 in position relative to the mandrel prior to setting.

Top cone 530 is designed to receive a top seal 560 over sleeve 532. Seal 560 includes an upper portion 562 and a lower portion 564 having different durometer values as required. A backup ring assembly 566 is also mounted between cone 530 and seal 560 and includes a first ring element 568 and a second ring element 570, both having serrations 572 and 574, respectively, as described with respect to the backup ring assembly 506 positioned adjacent to lower seal 490.

A lock hub 580 is positioned around mandrel 422 and above seal 560. Hub 580 has a collar 582 formed therearound and a central bore 583 of slightly greater diameter than the outside diameter of sleeve 532. Hub 580 is formed with a concentric bore for receiving lock ring 584 which is restrained from rotation relative to the hub by screw 586 which engages a slot in ring 584. Lock ring 584 has teeth 590 for cooperating with teeth 592 of hub 580. Lock ring 584 also has teeth 594 on the inside surface for cooperating with teeth 534 of sleeve 532. A ring 595 is received within a bore 596 of hub 580 and is positioned between seal 560 and hub 580.

A slip assembly 600 is positioned intermediate of bottom cone 500 and top cone 530 and has a plurality of segments 602 spaced around mandrel 422 and connected by wire 604. Slip segment 602 are also attached to the bottom and top cones by a plurality of shear pins 606 and 608, respectively. Segments 602 have opposed conical faces 610 and 612 of an angle corresponding to that of conical surfaces 502 and 554 of cones 500 and 530, respectively. Slip segments 602 have teeth 613 and 614 for engagement with the casing wall as will be described hereinafter.

Operation of the tool is substantially identical to that of tool 20, described hereinbefore. Briefly, tool 420 is run in the well casing with slip 600, cones 500 and 530 and seals 490 and 560 and lock hub 580 in the position shown in FIG. 10. Positioning the tool within the casing is by way of use of a wire line or the drill string with a setting tool T. Tool T has a central sleeve 622 for engagement within mandrel 422 and an outer sleeve 624 which engages collar 582 of lock hub 580. Mandrel 422 is attached to sleeve 622 of the setting tool using a shear ring 626.

Figure 11:
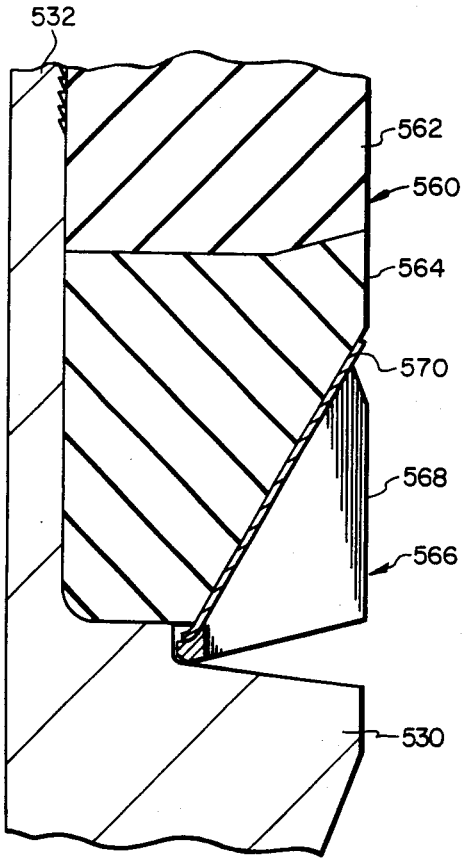
FIG. 11 is an enlarged portion of the upper seal and backup ring of the tool shown in FIG. 10.
Figure 12:
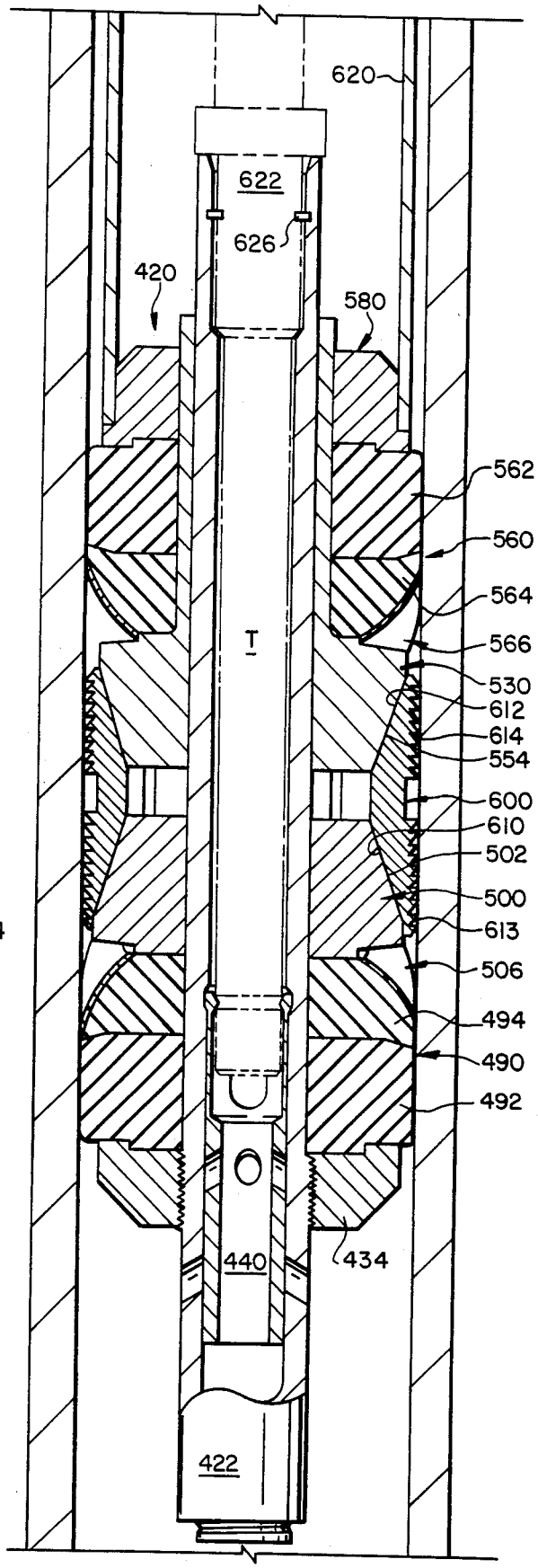
FIG. 12 is a sectional elevation view of casing within a well bore showing the tool of FIG. 10 in its set position within the casing.

With tool 420 positioned in the well casing at the desired depth, the tool is set by advancing sleeve 620. This results in the movement of lock hub 580 along mandrel 422 toward bottom assembly 434. As can be seen from the position which is reached in FIG. 11, the shear pins attaching the cones to the mandrel are sheared and cones 500 and 530 are moved inwardly relative to slip 600, shearing pins 606 and 608, and moving the slip segments 602 radially outwardly against casing C. This sets the tool relative to the casing. Continued movement of lock hub 580 relative to mandrel 422, causes the movement of lock ring 584 relative to sleeve 532 of cone 530. The teeth 594 of lock ring 584 ratchet past teeth 534 of sleeve 532 and seal 560 is compressed causing its radial expansion. Similarly, backup ring segments 566 and 570 fan outwardly as shown in FIG. 12 to provide anti-extrusion and support for the seal components. In view of the design of these teeth, this compression is not releasable.

In a second setting step, and subsequent to the packing off of seal 560, a reverse pull, or strain using sleeve 622 of the setting tool, is applied to mandrel 422 to lift bottom assembly 434 upwardly. In view of the engagement of slip segments 602 against the casing wall, movement of bottom assembly 434 upwardly results in the compression of bottom seal 490 to packoff the seal against the casing as shown in FIG. 12. Simultaneously therewith, backup rings 508 and 514 are fanned outwardly to provide support to the seal element.

The packoff of lower seal 490 is maintained by the engagement of teeth 550 of lock ring 544 with teeth 552 of mandrel 422. As can be seen in FIG. 10, the movement of lock ring 544 relative to cone 530 is prevented by the engagement of teeth 542 against teeth 540 of the cone.

As can be seen from a review of the setting operation, seal 560 is set independently of setting of seal 490. Thus, a different force may be applied to the packing structure to accommodate different forces which will be applied to the tool from below as compared to the hydraulic and other forces from above the tool. Further, seal 560 does not engage mandrel 422 either during the packoff of seal 560 or the packoff of lower seal 490. Thus, a lower setting friction is experienced due to this resulting in lower setting force required.

Figure 13:
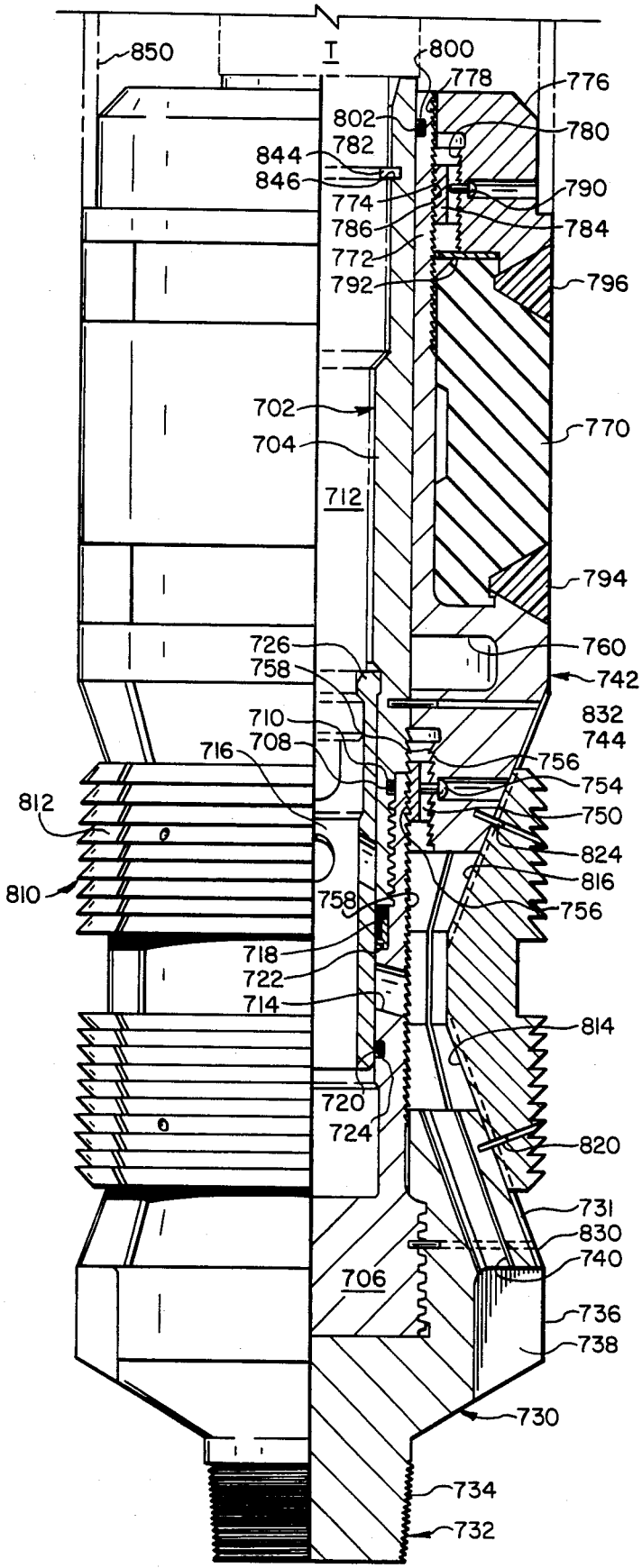
FIG. 13 shows a second embodiment of tool of the present invention in quarter-section and in the unset or running-in position; the tool of FIG. 13 is designed for use in low pressure, low temperature environments.

FIG. 13 illustrates a further alternative embodiment of the present invention showing a cement retainer 700 for use in low-pressure situations. Tool 700 includes a single packing element as compared to the tool of FIGS. 1–9 having both an upper and lower packing seal.

Figure 14:
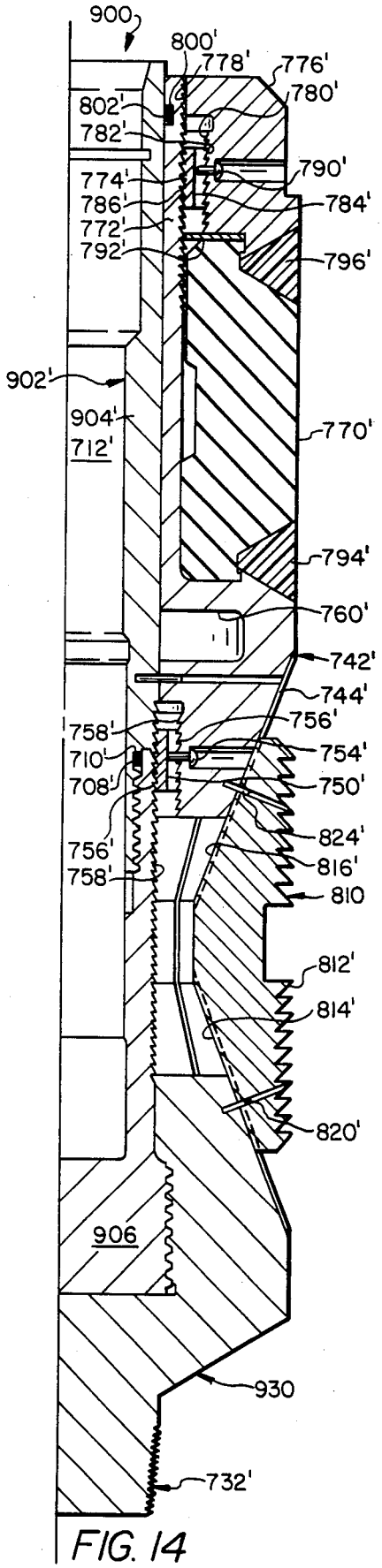
FIG. 14 is a quarter-section of an alternative form of the tool of the present invention in the form of a bridge plug.

The tool includes a two-piece mandrel 702 having an upper portion 704 joined by appropriate threads to a lower portion 706. A seal 708 is fitted in a gland 710 for providing a seal between portion 704 and 706. Mandrel 702 has a central passageway 712 therethrough which communicates to a plurality of ports 714 through the sidewall of lower portion 706. A movable valve 716 is positioned within the mandrel for movement between an upper and lower position to correspond to a closed and open position with respect to ports 714. Valve 716 is sealed above and below by seals 218 and 222, respectively. Seal 218 is a two piece seal positioned in a bore 722. Seal 720 is an O-ring seal seated in gland 724. As can be seen in FIG. 14, with the valve in the upper position, the upper portion of the valve has a boss which is received within collet groove 726 to maintain the valve in the closed position. The sidewall of valve 716 blocks port 714. With the valve in the lower, or open, position, ports 714 are open to central passageway 712 of the mandrel.

The lower portion 706 of mandrel 702 threadedly receives a bottom shoe assembly 730 thereon having a conical force 731. Bottom shoe assembly includes a pin end 732 with threads 734 for attachment of workover or service tools as required. Shoe assembly 730 includes a plurality of fins 736 and cavity 738 therebetween. Ports 740 are also provided as shown in FIG. 13. An upper cone 742 encircles the mandrel and includes a conical surface 744. The cone 742 has a counterbore 746 with teeth 748 formed internally therein. A lock ring 750 is positioned within the counterbore and has teeth 752 for engagement with teeth 748 of cone 742. Rotation of the lock ring 750 relative to cone 742 is prevented by the use of pin 754 which is received within a slot in the ring. The inner surface of ring 750 is formed with teeth 756 which mate with corresponding teeth 758 on the outer surface of mandrel 702. An annular void 760 is formed within cone 742 to remove material and facilitate the drillability of the tool and also to limit the amount of surface contact between the cone and mandrel to facilitate setting of the tool.

An expandible packer seal 770 is mounted around the mandrel and rides on a sleeve 772 extending from cone 742. Sleeve 772 has teeth 774 formed on the exterior thereof along an appropriate length from the end. A lock hub 776 is received around sleeve 772 and has an aperture 778 which is slightly larger diameter than sleeve 772. Lock hub 776 has a counterbore with teeth 780 formed internally therein for mating with teeth 782 of lock ring 784. Lock ring 784 has internal teeth 786 for engagement with teeth 774 of sleeve 772. Pin 790, positioned through lock hub 776 prevents rotation of lock ring 784 relative to the hub.

Packer seal 770 is positioned between cone 742 and lock hub 776 and has a top spacer ring 792 positioned between the seal and the hub. Two piece backup seal rings 794 and 796 are positioned between cones 742 and the seal and between. the seal and lock hub 776, as shown. Backup seal rings 794 and 796 have a wedge cross section. A gland 800 within sleeve 772 of cone 742 receives an O ring 802 for sealing between the sleeve and mandrel 702.

A slip assembly 810 is positioned around the mandrel between shoe assembly 730 and cone 742. Slip 810 includes slip segments 812 having conical surfaces 814 and 816 corresponding to conical surfaces 731 and 744 of shoe assembly 730 and cones 742, respectively. Slip segments are maintained in position, prior to setting of the tool, by use of pins 820 and 824. Conical surfaces 731 and 742 are formed with a plurality of dovetails 830 and 832, respectively for engaging corresponding dovetails on conical surfaces 814 and 816 of slip segments 812 to prevent rotation of the slip segments relative to the tool.

Operation of the tool is as follows. The tool is mounted on a setting tool T having an inner sleeve 842 for receiving a shear ring 844 which is also mounted in an annular groove 846 within the inside wall of mandrel 702. Tool T includes appropriate attachment means for attachment to a wire line or to the drill string, as desired. The setting tool also includes an outer sleeve 850 which engages lock hub 776 at collar 778.

The tool is run into the well casing to a desired depth. By applying a downward pressure through sleeve 850 of setting tool 840, lock hub 776 is moved relative to mandrel 702 and toward shoe assembly 730. Slip segments 812 are caused to ride up on conical surfaces 731 and 744 of shoe assembly 730 and cone 742, respectively, and move radially outwardly for engagement with the casing wall.

The position of slip segments 812 is maintained in the set or radially expanded position by the movement of cone 742 relative to mandrel 702. Lock ring 750 moves downwardly relative to the mandrel with its teeth 756 being ratcheted over teeth 758 of the mandrel and locked in place at the advance position. Movement of cone 742 from the set position is prevented by the engagement of teeth 748 against teeth 752 of lock ring 750. By continuing the application of pressure on lock hub 776, the hub is advanced relative to cone 742 to compress seal 770 and thereby radially expand the seal until contact is made with the casing inside wall. The position of lock hub 776 relative to cone 742 is maintained by the engagement of lock ring 784 with sleeve 772 by way of teeth 786 and teeth 774 on the ring and sleeve, respectively.

With the tool set in place, cement may be delivered through central passage 712, and with valve 716 in the opened position, through port 714 and port 740 of shoe assembly 730. It will be noticed that in the present design, cement will be loaded both in tin cavity 738 and within the area beneath slip segments 812. Thus, the slip segments are maintained in their set position by the presence of such cement and also rotation of the various components relative to the casing is resisted during drillout.

As with respect to the disclosure regarding the tool of FIGS. 1–9, a significant number of the components of tool 700 may be made from a synthetic resin material. Specifically, shoe assembly 730, cone 742, backup rings 794 and 796, and lock hub 776 may be made from the synthetic resin material described hereinabove. Thus, drill out of the present tool is greatly facilitated where removal of the tool is required. As with respect to the tool described in FIGS. 1–9, the present tool may be removed from the casing by drilling in a substantially shorter time than that required for conventional tools.

FIG. 14 shows the application of the present invention to a bridge plug as opposed to the use of the present concept for a cement retainer. A bridge plug differs from a cement retainer in that it does not incorporate valving structure permitting the flow of fluids beyond the tool location in the casing. The plug is positioned in the casing to provide a bottom to permit flow control operations above the tool, typically flow of fluids into a zone of interest above the bride plug and below a squeeze packer.

Referring to FIG. 14, a bridge plug 900 is shown, incorporating structural components similar to those of tool 700 in FIG. 14. In this tool, mandrel 902 includes an upper portion 904 with a lower portion 906 mated thereto. It will be appreciated that lower portion 906 differs from the lower portion of the mandrel in cement retainer 700 of FIG. 13 by not having any ports therethrough. Further, a control valve is not required as is incorporated in the cement retainer. The bridge plug 900 includes a shoe assembly 930 which is identical to that of shoe assembly 730 of the cement retainer 700 with the exception that ports are not provided through the assembly as exist in the cement retainer. As can be seen in FIG. 14, the remaining components of the bridge plug are identical to those of the cement retainer FIG. 13 and are given the same number, with the addition of the designation prime (′), for purposes of identification. The setting and operation of the bridge plug 900 is also identical to that of the cement retainer 700.

Although preferred embodiments of the invention have been described in the foregoing Detailed Description and illustrated in the accompanying drawings, it will be understood that the invention is not limited to the embodiment disclosed, but is capable of numerous rearrangements, modifications and substitutions of parts and elements without departing from the spirit of the invention. Accordingly, the present invention is intended to encompass such rearrangements, modifications and substitutions of parts and elements that falls within the spirit and scope of the invention.

We claim:

1. A tool for controlling the flow of fluid in a well casing in an oil or gas well comprising:

a tubular mandrel having a flow passage therethrough with means for connecting one end of the mandrel to the well drill string and with the second end having a flow control valve associated therewith, a radially expandable seal member encircling and carried on said mandrel, an abutment member attached to and movable with said mandrel for engaging one side of said seal member, a bottom cone positioned around said mandrel and on the opposite side of said seal member from said abutment member, said cone having a sleeve extending therefrom and positioned between said seal and said mandrel and having a conical surface opposite said seal, an upper cone positioned around said mandrel and having a conical surface confronting the conical surface of said bottom cone, slip segments positioned around said mandrel and intermediate of said cones with conical surfaces for engagement with the conical surfaces of said cones, and a lock hub positioned around said mandrel and on the side of said upper cone opposite said slip segments, said hub to receive applied pressure to move relative to said mandrel toward such slip segments causing radial movement thereof and the compression and radial expansion of said seal.

2. The tool according to claim 1 wherein said abutment member is formed of a high-strength synthetic resin.

3. The tool according to claim 1 wherein said abutment member is formed of a glass-fiber-filled polyamide material.

4. The tool according to claim 1 wherein said bottom and upper cones are formed of a high-strength synthetic resin.

5. The tool according to claim 1 wherein said bottom and upper cones are formed of a glass-fiber-filled polyamide material.

6. The tool according to claim 1 wherein said lock hub means is formed of a high-strength synthetic resin.

7. The tool according to claim 1 wherein said lock hub means is formed of a glass-fiber-filled polyamide material.

8. The tool according to claim 1 further comprising an upper radially expandable seal member encircling and carried on said mandrel intermediate of said lock hub means and said upper cone, and a sleeve extending from said upper cone encircling said mandrel and positioned between said upper seal and said mandrel.

9. The tool according to claim 8 further comprising:

first lock ring means associated with said lock hub for setting said hub relative to the sleeve extending from said upper cone.

10. The tool according to claim 9 further comprising:

second lock ring means associated with said upper cone for setting said upper cone relative to said mandrel.

11. The tool according to claim 8 further comprising an annular seal member positioned between the sleeve of said upper cone and said mandrel to form a seal therebetween.

12. A tool for controlling the flow of fluid in a well casing in an oil or gas well comprising:

a tubular mandrel with means for connecting one end of the mandrel to the well string, a radial expandable seal member encircling and carried on said mandrel, an abutment member attached to and movable with said mandrel for engaging one side of said seal member, a cone positioned around said mandrel and one on the opposite side of said seal member from said abutment member, slip segment positioned around said mandrel with a conical surface for engagement with the conical surface of said cone, lock hub means positioned around said mandrel on the side of said cone opposite said slip segments, said hub to receive applied pressure to move relative to said mandrel toward said slip segments causing expansion thereof and the compression of said seal, said cone being formed from a high strength synthetic resin material having maximum tensile strength of about 30,000 psi and a modulus of elasticity between about 900,000 to 4,000,000 psi.

13. The tool according to claim 12 wherein said abutment member is formed of a high-strength synthetic resin having a maximum tensile strength of about 30,000 psi and a modulus of elasticity between about 900,000 to 4,000,000 psi.

14. The tool according to claim 12 wherein said lock hub means is formed of a high-strength synthetic resin having a maximum tensile strength of about 30,000 psi and a modulus of elasticity between about 900,000 to 4,000,000 psi.

15. In a downhole tool for controlling the flow of fluid in a well casing in an oil or gas well comprising:

a tubular mandrel with means for connecting one end of the mandrel to the well drill string, an abutment member attached to and moveable with said mandrel, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said seal member and having a conical surface, slip segments positioned around said mandrel and intermediate of said abutment member and said seal member and having a conical surface for engagement with the conical surface of said cone, said hub means adapted to receive applied pressure to move relative to said mandrel toward such slip segment causing expansion thereof and the compression of said seal.

16. The tool according to claim 15 wherein said cone is formed of a high-strength synthetic resin.

17. The tool according to claim 15 wherein said abutment member is formed of a high-strength synthetic resin.

18. The tool according to claim 15 wherein said lock hub means is formed of a high-strength synthetic resin.

19. A tool for controlling the flow of fluid in a well casing in an oil or gas well comprising:

a tubular mandrel with means for connecting one end of the mandrel to the well string, a radial expandable seal member encircling and carried on said mandrel, an abutment member attached to and movable with said mandrel for engaging one side of said seal member, a cone positioned around said mandrel and one on the opposite side of said seal member from said abutment member, slip segment positioned around said mandrel with a conical surface for engagement with the conical surface of said cone, lock hub means positioned around said mandrel on the side of said cone opposite said slip segments, said hub to receive applied pressure to move relative to said mandrel toward said slip segments causing expansion thereof and the compression of said seal, said cone being formed from a high strength synthetic material, wherein said cone, abutment member and lock hub are formed of a glass-fiber-filled polyamide material.

20. A tool for controlling the flow of fluid in a well casing in an oil or gas well comprising:

a tubular mandrel with means for connecting one end of the mandrel to the well string, a radial expandable seal member encircling and carried on said mandrel, an abutment member attached to and movable with said mandrel for engaging one side of said seal member, a cone positioned around said mandrel and one on the opposite side of said seal member from said abutment member, slip segment positioned around said mandrel with a conical surface for engagement with the conical surface of said cone, lock hub means positioned around said mandrel on the side of said cone opposite said slip segments, said hub to receive applied pressure to move relative to said mandrel toward said slip segments causing expansion thereof and the compression of said seal, said cone being formed from a high strength synthetic material, wherein said lock hub means is formed of a high strength synthetic resin and wherein said synthetic material has a deflection temperature of at least about 400° F. fully loaded and has a suitably high modulus of elasticity.

21. A tool for controlling the flow of fluid in a well casing in an oil or gas well comprising:

a tubular mandrel with means for connecting one end of the mandrel to the well string, a radial expandable seal member encircling and carried on said mandrel, an abutment member attached to and movable with said mandrel for engaging one side of said seal member, a cone positioned around said mandrel and one on the opposite side of said seal member from said abutment member, said cone having a sleeve extending therefrom encircling said mandrel and positioned between said seal and said mandrel, slip segment positioned around said mandrel with a conical surface for engagement with the conical surface of said cone, lock hub means positioned around said mandrel on the side of said cone opposite said slip segments, said hub to receive applied pressure to move relative to said mandrel toward said slip segments causing expansion thereof and the compression of said seal, said cone being formed from a high strength synthetic material.

22. In a downhole tool for controlling the flow of fluid in a well casing in an oil or gas well comprising:

a tubular mandrel with means for connecting one end of the mandrel to the well drill string, an abutment member attached to and moveable with said mandrel, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said lock hub means and having a conical surface, said cone being formed of a high-strength synthetic resin and said synthetic material having a deflection temperature of at least about 400° F. fully loaded and has a suitably high modulus of elasticity, and slip segments positioned around said mandrel and intermediate of said abutment member and said lock hub means and having a conical surface for engagement with the conical surface of said cone, said hub means adapted to receive applied pressure to move relative to said mandrel toward such slip segment causing expansion thereof and the compression of said seal.

23. The tool according to claim 22 further comprising an annular seal member positioned between the sleeve of said cone and said mandrel to form a seal therebetween.

24. In a downhole tool for controlling the flow of fluid in a well casing in an oil or gas well comprising:

a tubular mandrel with means for connecting one end of the mandrel to the well drill string, an abutment member attached to and moveable with said mandrel, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said lock hub means and having a conical surface, said cone being formed of a glass-fiber-filled polyamide material, and slip segments positioned around said mandrel and intermediate of said abutment member and said lock hub means and having a conical surface for engagement with the conical surface of said cone, said hub means adapted to receive applied pressure to move relative to said mandrel toward such slip segment causing expansion thereof and the compression of said seal.

25. In a downhole tool for controlling the flow of fluid in a well casing in an oil or gas well comprising:

a tubular mandrel with means for connecting one end of the mandrel to the well drill string, an abutment member attached to and moveable with said mandrel, said abutment member being formed of a glass-fiber-filled polyamide material, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said lock hub means and having a conical surface, slip segments positioned around said mandrel and intermediate of said abutment member and said lock hub means and having a conical surface for engagement with the conical surface of said cone, said hub means adapted to receive applied pressure to move relative to said mandrel toward such slip segment causing expansion thereof and the compression of said seal.

26. The tool according to claim 25 wherein said synthetic material has a deflection temperature of at least about 400° F. fully loaded and has a suitably high modulus of elasticity.

27. In a downhole tool for controlling the flow of fluid in a well casing in an oil or gas well comprising:

a tubular mandrel with means for connecting one end of the mandrel to the well drill string, an abutment member attached to and moveable with said mandrel, lock hub means positioned around said mandrel for movement relative to said mandrel, said lock hub means being formed of a high-strength synthetic resin and said synthetic material having a deflection temperature of at least about 400° F. fully loaded and has a suitably high modulus of elasticity, a radially expandable seal member encircling and carried on said mandrel intermediate of said abutment member and said lock hub means, a cone member positioned around said mandrel intermediate of said abutment member and said lock hub means and having a conical surface, slip segments positioned around said mandrel and intermediate of said abutment member and said lock hub means and having a conical surface for engagement with the conical surface of said cone, said hub means adapted to receive applied pressure to move relative to said mandrel toward such slip segment causing expansion thereof and the compression of said seal.

28. In a downhole tool for controlling the flow of fluid in a well casing in an oil or gas well comprising:

a tubular mandrel with means for connecting one end of the mandrel to the well drill string, an abutment member attached to and moveable with said mandrel, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said lock hub means and having a conical surface, slip segments positioned around said mandrel and intermediate of said abutment member and said lock hub means and having opposed conical surfaces, one said conical surface for engagement with the conical surface of said cone, and wherein said abutment member comprises a conical ramp surface for engagement with the other of the conical surfaces of said slip segment, said segments being positioned between said abutment member and said cone member, and said hub means adapted to receive applied pressure to move relative to said mandrel toward such slip segment causing expansion thereof and the compression of said seal.

29. In a downhole tool for controlling the flow of fluid in a well casing in an oil or gas well comprising:

a tubular mandrel with means for connecting one end of the mandrel to the well drill string, an abutment member attached to and moveable with said mandrel, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said lock hub means and having a conical surface, said cone having a sleeve extending therefrom encircling said mandrel and positioned between said seal member and said mandrel, and slip segments positioned around said mandrel and intermediate of said abutment member and said lock hub means and having a conical surface for engagement with the conical surface of said cone, said hub means adapted to receive applied pressure to move relative to said mandrel toward such slip segment causing expansion thereof and the compression of said seal.

30. The tool according to claim 29 wherein said mandrel has a control valve therein for controlling the flow of fluid through an aperture intermediate said abutment member and once therethrough for communicating fluid from intermediate of said abutment member and said cone member to a point exterior of said slip segments.

31. In a downhole tool for controlling the flow of fluid in a well casing in an oil or gas well comprising:

a tubular mandrel with means for connecting one end of the mandrel to the well drill string, an abutment member attached to and moveable with said mandrel, said abutment member including a plurality of cavities formed therein with fins extending outwardly adjacent thereto, lock hub means positioned around said mandrel for movement relative to said mandrel, a radially expandable seal member encircling and carried on said mandrel intermediate of said abutment member and said lock hub means, a cone member positioned around said mandrel intermediate of said abutment member and said lock hub means and having a conical surface, slip segments positioned around said mandrel and intermediate of said abutment member and said lock hub means and having a conical surface for engagement with the conical surface of said cone, said hub means adapted to receive applied pressure to move relative to said mandrel toward such slip segment causing expansion thereof and the compression of said seal.

32. The tool according to claim 31 further comprising an annular seal member positioned between the sleeve of said cone and said mandrel to form a seal therebetween.

* * * * *